US010501924B2

(12) United States Patent
Brown et al.

(10) Patent No.: US 10,501,924 B2
(45) **Date of Patent: *Dec. 10, 2019**

(54) URINAL SCREENS

(71) Applicant: Fresh Products, Inc., Toledo, OH (US)

(72) Inventors: Douglas S. Brown, Toledo, OH (US); Jeffrey A. Smith, Perrysburg, OH (US)

(73) Assignee: Fresh Products, Inc., Perrysburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/175,379

(22) Filed: Oct. 30, 2018

(65) Prior Publication Data

US 2019/0264435 A1 Aug. 29, 2019

Related U.S. Application Data

(63) Continuation of application No. 14/925,369, filed on Oct. 28, 2015, now Pat. No. 10,145,098.

(60) Provisional application No. 62/075,827, filed on Nov. 5, 2014.

(51) Int. Cl.
*E03D 9/00* (2006.01)
*E03D 13/00* (2006.01)

(52) U.S. Cl.
CPC ..... *E03D 13/005* (2013.01); *E03D 9/00* (2013.01); *E03D 9/007* (2013.01)

(58) Field of Classification Search
CPC ..... E03D 13/005
USPC ..... 4/256.1
See application file for complete search history.

(56) References Cited

U.S. PATENT DOCUMENTS

| | | | |
|---|---|---|---|
| 333,935 | A | 1/1886 | Duncan |
| 555,888 | A | 3/1896 | Roberts |
| 810,973 | A | 1/1906 | Pattenden et al. |
| 927,026 | A | 7/1909 | Clayton |
| 950,574 | A | 3/1910 | Morgan |
| 1,109,904 | A | 9/1914 | Dahlgren |
| 1,208,675 | A | 12/1916 | Sleight |
| 1,260,082 | A | 3/1918 | Sleight |
| 1,292,856 | A | 1/1919 | Niblo |
| 1,731,431 | A | 10/1929 | Meyer |

(Continued)

FOREIGN PATENT DOCUMENTS

| | | | |
|---|---|---|---|
| DE | 1915249 | A1 | 10/1970 |
| DE | 19541911 | A1 | 5/1997 |

(Continued)

OTHER PUBLICATIONS

Dugdale, David C., "Uroflometry" MedlinePlus Medical Encyclopedia, 2008. http://www.nlm.nih.gov/medlineplus/ency/article/003325.htm, retrieved on Oct. 28, 2014, .2 pages.

(Continued)

*Primary Examiner* — Lauren A Crane
(74) *Attorney, Agent, or Firm* — Knobbe Martens Olson & Bear LLP

(57) ABSTRACT

A urinal assembly having a frame and a plurality of posts or posts extending from the frame. The frame can include a plurality of openings. The openings can be defined by a plurality of sides and corners. The posts can extend from the corners and/or from the sides of the openings. In some embodiments, posts extend from a first face and a second face of the frame.

33 Claims, 6 Drawing Sheets

(56) References Cited

U.S. PATENT DOCUMENTS 1,880,962 A 10/1932 Koppelman
1,886,676 A 11/1932 Heuacker
1,935,128 A 11/1933 Pullman
2,011,732 A 8/1935 Saeks
2,020,864 A 11/1935 Aronson et al.
2,087,592 A 7/1937 Chesnut
2,211,970 A 8/1940 Fischer
2,233,234 A 2/1941 Wilson
2,447,178 A 8/1948 Hatchette
2,506,669 A 5/1950 Heuacker
2,508,808 A 5/1950 Warman
2,679,054 A 5/1954 Singleton
2,690,569 A 10/1954 Kozerski
2,931,047 A 4/1960 Stebbins
2,984,841 A 5/1961 Wilson
3,170,169 A 2/1965 Clark
3,237,330 A 3/1966 Dinstbir
3,248,740 A 5/1966 Wisnom
3,268,920 A 8/1966 Beer
3,329,998 A 7/1967 Stohr
3,387,069 A 6/1968 Stohr
3,422,558 A 1/1969 Fee
3,540,433 A 11/1970 Brockman
3,597,772 A 8/1971 Leavitt et al.
3,614,790 A 10/1971 Billingsly et al.
3,631,560 A 1/1972 Atkins
3,723,998 A 4/1973 Wehr
3,752,121 A 8/1973 Brazzell
3,760,429 A 9/1973 Brownstein
3,788,485 A 1/1974 Bruning
3,804,796 A 4/1974 Alexandre
3,824,633 A 7/1974 Van Vlahakis
3,837,988 A 9/1974 Hennen et al.
3,867,953 A 2/1975 Stohr
3,899,192 A 8/1975 Reddaway
3,923,442 A 12/1975 Stohr
3,935,602 A 2/1976 Kale
4,010,497 A 3/1977 Menter et al.
4,095,031 A 7/1978 Engle
4,103,367 A 8/1978 Kaufer
D253,145 S 10/1979 Adam
D255,744 S 7/1980 Dekko
4,212,153 A 7/1980 Kydonieus et al.
4,215,443 A 8/1980 Babik
D258,181 S 2/1981 Adam
D258,472 S 3/1981 Adam
4,305,216 A 12/1981 Skelton
4,361,606 A 11/1982 Butler et al.
4,389,963 A 6/1983 Pearson
4,405,509 A 9/1983 Rogers et al.
4,408,557 A 10/1983 Bradley et al.
4,418,432 A 12/1983 Vidal
4,440,542 A 4/1984 Foley
4,490,862 A 1/1985 Vidal
4,515,909 A 5/1985 Sarwano et al.
D280,267 S 8/1985 Bryant et al.
4,549,693 A 10/1985 Barlics
4,552,693 A 11/1985 Hussain et al.
4,557,863 A 12/1985 Callewaert et al.
4,574,400 A 3/1986 Annowsky
4,574,403 A 3/1986 Dintemann et al.
4,604,357 A 8/1986 Callenwaert et al.
4,612,676 A 9/1986 Whitman
4,671,976 A 6/1987 Vidal
4,750,219 A 6/1988 Williams
4,761,437 A 8/1988 Christie
4,815,767 A 3/1989 Lambert
4,830,407 A 5/1989 Sadler, Jr. et al.
4,866,793 A 9/1989 Luedtke et al.
4,941,688 A 7/1990 Jones
4,985,940 A 1/1991 Jones
5,010,599 A 4/1991 Nilsson
5,019,434 A 5/1991 Matsumoto
5,058,088 A 10/1991 Haas et al.
5,058,523 A 10/1991 Mikkonen et al.
5,087,273 A 2/1992 Ward
5,117,515 A 6/1992 White, Jr. et al.
5,130,016 A 7/1992 Gavin
5,139,864 A 8/1992 Lindauer
D329,893 S 9/1992 Luedtke et al.
5,150,481 A 9/1992 Pang
5,150,722 A 9/1992 Rutherford
5,165,119 A 11/1992 Yamato
5,188,755 A 2/1993 Chang
D341,414 S 11/1993 Baker
5,309,578 A 5/1994 Temple, Sr.
5,313,672 A 5/1994 Luedtke et al.
5,336,424 A 8/1994 Van Vlahakis et al.
5,364,132 A 11/1994 Haas et al.
5,365,616 A 11/1994 Morad
5,377,362 A 1/1995 Jackson
5,398,347 A 3/1995 Luedtke et al.
5,472,712 A 12/1995 Oshlack et al.
5,479,735 A 1/1996 Martin, Jr.
5,482,007 A 1/1996 Kumlin
5,489,415 A 2/1996 Van Vlahakis et al.
5,496,300 A 3/1996 Hirsch et al.
D370,938 S 6/1996 Roach
5,556,685 A 9/1996 Swicegood, Jr.
5,580,578 A 12/1996 Oshlack et al.
5,604,937 A 2/1997 Davenport
5,639,476 A 6/1997 Oshlack et al.
5,660,138 A 8/1997 Hirsch
5,719,828 A 2/1998 Haas et al.
D393,896 S 4/1998 Wagner et al.
5,774,905 A 7/1998 Wager et al.
5,809,590 A 9/1998 Williams et al.
5,813,058 A 9/1998 Quigley et al.
5,867,848 A 2/1999 Ort
5,885,701 A 3/1999 Berman et al.
5,958,334 A 9/1999 Haddon
5,961,148 A 10/1999 Cheng
D422,061 S 3/2000 Lee
6,055,681 A 5/2000 Lyons
D427,295 S 6/2000 Wagner
6,079,975 A 6/2000 Conover
6,081,937 A 7/2000 Whitacre
6,103,201 A 8/2000 Green
6,103,351 A 8/2000 Ram et al.
6,113,148 A 9/2000 Koranda et al.
D438,710 S 3/2001 Chen
6,207,236 B1 3/2001 Araki et al.
6,213,409 B1 4/2001 Warren et al.
D442,246 S 5/2001 McCabe et al.
6,244,208 B1 6/2001 Qui et al.
6,265,084 B1 7/2001 Stickler
6,279,759 B1 8/2001 Weisback
D456,492 S 4/2002 Lourens
6,370,705 B1 4/2002 Levinson
D464,122 S 10/2002 Mangan
6,517,759 B1 2/2003 Ferenc et al.
6,640,350 B1 11/2003 Deutsch
6,698,035 B1 3/2004 Grueser
6,703,012 B1 3/2004 White
6,730,311 B2 5/2004 Maleeny et al.
6,787,210 B2 9/2004 Stickler
6,823,533 B2 11/2004 Casari
6,862,754 B1 3/2005 DeMarco
6,920,648 B1 7/2005 Suski et al.
6,927,199 B2 8/2005 Takemura et al.
6,988,462 B1 1/2006 Zhu
D520,610 S 5/2006 Wrate
7,061,831 B2 6/2006 De La Huerga
D528,193 S 9/2006 Lee
7,127,844 B2 10/2006 Collins
7,202,201 B1 4/2007 Williams
D561,327 S 2/2008 DeJonge et al.
7,398,565 B1 * 7/2008 Chou ..... E03D 13/005
4/300.3
7,413,082 B2 8/2008 Adler et al.
7,419,588 B2 9/2008 Lawson
7,434,535 B2 10/2008 Adamy
7,528,102 B2 5/2009 Barthel et al.
D598,075 S 8/2009 Uhl

(56) References Cited

U.S. PATENT DOCUMENTS

| | | | |
|---|---|---|---|
| 7,742,367 | B2 | 6/2010 | Haas |
| 7,808,861 | B2 | 10/2010 | Wien |
| 7,833,515 | B2 | 11/2010 | Corzani et al. |
| 7,904,972 | B2 | 3/2011 | Anderson |
| 7,921,479 | B2 | 4/2011 | Hunter |
| 7,921,583 | B2 | 4/2011 | Londino |
| D639,410 | S | 6/2011 | Ramirez |
| 8,007,707 | B1 | 8/2011 | Brown |
| 8,043,498 | B2 | 10/2011 | Rueda |
| D678,482 | S | 3/2013 | Williams |
| D678,483 | S | 3/2013 | Barker |
| D682,398 | S | 5/2013 | Lee |
| D687,524 | S | 8/2013 | Heiser |
| D687,525 | S | 8/2013 | Heiser |
| 8,856,977 | B2 | 10/2014 | Ramirez |
| 9,243,394 | B2 | 1/2016 | Brown et al. |
| D778,411 | S | 2/2017 | Brown et al. |
| D778,412 | S | 2/2017 | Brown et al. |
| D790,042 | S | 6/2017 | Ramirez |
| D805,613 | S | 12/2017 | D'Amico et al. |
| D806,835 | S | 1/2018 | D'Amico et al. |
| D806,837 | S | 1/2018 | D'Amico et al. |
| D824,495 | S | 7/2018 | D'Amico et al. |
| D824,496 | S | 7/2018 | D'Amico et al. |
| 10,036,154 | B2 | 7/2018 | Crevier |
| 10,087,612 | B2 | 10/2018 | Brown et al. |
| 10,145,098 | B2 | 12/2018 | Brown et al. |
| D838,818 | S | 1/2019 | Malesky et al. |
| D841,359 | S | 2/2019 | Crevier |
| D857,181 | S | 8/2019 | Brown |
| 2002/0037385 | A1 | 3/2002 | Pignot et al. |
| 2003/0044326 | A1 | 3/2003 | Yamasaki et al. |
| 2005/0022298 | A1 | 2/2005 | De Leon et al. |
| 2005/0067106 | A1 | 3/2005 | Melges |
| 2005/0112339 | A1 | 5/2005 | Sandel et al. |
| 2005/0144711 | A1 | 7/2005 | Valadez et al. |
| 2005/0169793 | A1 | 8/2005 | Wheatley et al. |
| 2005/0245671 | A1 | 11/2005 | Moon et al. |
| 2005/0283892 | A1 | 12/2005 | Simeone et al. |
| 2006/0232059 | A1 | 10/2006 | Fortune et al. |
| 2007/0023539 | A1 | 2/2007 | Brown et al. |
| 2007/0039089 | A1 | 2/2007 | Worrel |
| 2007/0161927 | A1 | 7/2007 | Daugirdas |
| 2007/0186337 | A1 | 8/2007 | Emr |
| 2008/0098505 | A1 | 5/2008 | Casari |
| 2008/0100057 | A1 | 5/2008 | MacPhee |
| 2008/0292509 | A1 | 11/2008 | D'Amico |
| 2009/0070923 | A1 | 3/2009 | Ruedas |
| 2009/0229511 | A1 | 9/2009 | Campbell et al. |
| 2009/0255053 | A1 | 10/2009 | Cutrone, III |
| 2010/0183694 | A1 | 7/2010 | Burke |
| 2013/0067651 | A1 | 3/2013 | Brown et al. |
| 2014/0007336 | A1 | 1/2014 | Mills et al. |
| 2014/0157501 | A1* | 6/2014 | D'Amico ..... E03D 13/005 4/256.1 |
| 2014/0259344 | A1 | 9/2014 | Muderlak et al. |
| 2016/0102451 | A1 | 4/2016 | Brown et al. |
| 2018/0023278 | A1 | 1/2018 | Brown et al. |

FOREIGN PATENT DOCUMENTS

| | | | |
|---|---|---|---|
| EP | 0153946 | | 9/1985 |
| FR | 2681232 | A1 | 3/1993 |
| GB | 189518394 | A | 8/1896 |
| GB | 2431101 | | 4/2007 |
| JP | 57-17599 | | 1/1982 |
| JP | 60-178497 | | 11/1985 |
| JP | 60-190865 | | 12/1985 |
| JP | 63-116585 | | 7/1988 |
| JP | 1990-102625 | A | 4/1990 |
| JP | 1992-119880 | U | 10/1992 |
| JP | 2001-303642 | | 10/2001 |
| KR | 100351178 | | 5/2002 |
| KR | 0368846 | U | 11/2004 |
| WO | WO 2014/043725 | A1 | 3/2014 |
| WO | WO 2016/060998 | | 4/2016 |
| WO | WO 2019/126217 | A1 | 6/2019 |

OTHER PUBLICATIONS

Gray, Henry. "The Male Urethra". Anatomy of the Human Body, 3b. 4, 1918. http://www.bartleby.com/107/256.html, retrieved on Oct. 27, 2014. 5 pages.

Ritter, R. C. et al., "Analysis of Drop Intervals in Jets Modelling Obstruction of the Urinary Tract," Physics in Medicine and Biology, 1974, vol. 19, No. 2, 161-170, 11 pages.

Ritter, R. C. et al., "Physical Information in the External Urinary Stream of the Normal and Obstructed Adult Male, " British Journal of Urology, 1977, vol. 49, 293-302, 10 pages.

Defendant Impact Products, LLC, Answer and Affirmative Defenses Demand for Jury Trial, Case No. 2:19-cv-05994 GW(AFMx), filed Sep. 14, 2019.

Plaintiff Fresh Products, Inc., Complaint for Patent Infringement Demand for Jury Trial, Case No. 2:19-cv-05994, filed Jul. 11, 2019. The Pearl 3D urinal screen product cut sheet, and 3D renderings of the Pearl 3D urinal screen product, in three pages. The cut sheet includes a date of Sep. 2013; however, Applicant makes no representations as to the accuracy of this date. Applicant further makes no representation as to whether the 3D renderings accurately represent the product shown in the cut sheet and as to whether the 3D renderings accurately represent any prior art product. Applicant requests that the Examiner review the reference as prior art. Applicant reserves the right to disqualify the reference as prior art if needed.

* cited by examiner

URINAL SCREENS

CROSS REFERENCE TO RELATED APPLICATIONS

Any and all applications for which a foreign or domestic priority claims is identified in the Application Data Sheet as filed with the present application are hereby incorporated by reference under 37 CFR 1.57.

TECHNICAL FIELD

Certain embodiments discussed herein relate to restroom screens and mats, and, more particularly, the present inventions relate to restroom urinal screens and mats.

DISCUSSION OF THE RELATED ART

Urinal screens are widely used as air fresheners and to prevent debris from being flushed down a urinal drain. In some cases, a fragrance is provided with the screens to help sanitize and freshen the air in and around the urinal.

SUMMARY OF THE INVENTIONS

A urinal screen can include a frame. In some embodiments, the frame has a first face and a second face opposite the first face. The frame can include a plurality of openings extending through the first face and the second face. In some cases, the screen includes a plurality of first posts extending from the first face of the frame. The screen can include a plurality of second posts extending from the second face of the frame.

According to some variants, the portion of the frame defining each of the openings has a polygonal perimeter structure. In some embodiments, each perimeter structure defining an opening has a plurality of braces and corners. In some cases, a plurality of the braces and corners are shared between two or more openings. In some embodiments, the braces and corners form a tessellation. According to some variants, each of plurality of first posts extends from the portion of the frame defining a corner of a perimeter structure forming one or more of the plurality of openings. In some cases, each of plurality of second posts extends from a midpoint of a brace of a the portion of the frame defining a perimeter structure forming one or more of the plurality of openings. In some embodiments, at least one of the plurality of second posts extends from each of the braces of the perimeter structure defining the openings. In some cases, at least one of the plurality of first posts extends from each of the corners of the perimeter structure defining the openings. In some embodiments, at least one of the plurality of second posts extends from each of the braces of the perimeter structure defining the openings and at least one of the plurality of first posts extends from each of the corners of the perimeter structure defining the openings. According to some variants, at least one of the plurality of second posts extends from a brace or corner of the portion of the perimeter structure defining each opening. In some embodiments, at least one of the plurality of first posts extends from a brace of the perimeter structure defining each opening or corner of the perimeter structure defining each opening. In some cases, each of the plurality of first posts is substantially identical to one or more of the plurality of second posts.

According to some variants, a thickness of the frame in a direction perpendicular to the first face of the frame is less than one fourth of an overall thickness of the urinal screen in the direction perpendicular to the first face of the frame. In some cases, a thickness of the frame in a direction perpendicular to the first face of the frame is less than one eighth of an overall thickness of the urinal screen in the direction perpendicular to the first face of the frame. In some embodiments, when the urinal screen is set upon a surface such that the first or second face of the frame is oriented toward the surface, the frame is positioned away from the surface by at least one third of a thickness of the urinal screen as measured perpendicular to the first face of the frame. In some cases, the plurality of openings occupy at least three fourths of a surface area of the frame as measured parallel to the first face (e.g., the first plane) of the frame. In some embodiments, the perimeter structures defining the plurality of openings occupy less than one fifth of a surface area of the frame as measured parallel to the first face (e.g., the first plane) of the frame.

According to some variants, a urinal screen includes a frame. The frame can have: a first face; a second face opposite the first face; and a plurality of openings extending through the frame between the first face and the second face. The urinal screen can include a plurality of first posts extending from the first face of the frame. In some embodiments, the urinal screen includes a plurality of second posts extending from the second face of the frame. In some embodiments, a plurality of ends of the plurality of second posts form a base upon which the urinal screen rests when the plurality of first posts point away from a surface upon which the urinal screen is set. In some embodiments, at least half of the plurality of first posts are a same size and shape as at least half of the plurality of second posts.

In some configurations, each of the openings is defined by a polygonal perimeter structure.

In some configurations, each opening is defined by a perimeter structure having plurality of braces and corners.

In some configurations, each of plurality of first posts extends from a corner of a perimeter structure of one or more of the plurality of openings.

In some configurations, each of plurality of second posts extends from a midpoint of a brace of a perimeter structure of one or more of the plurality of openings.

In some configurations, at least one of the plurality of second posts extends from each of the braces of the perimeter structure defining the openings.

In some configurations, at least one of the plurality of first posts extends from each of the corners of the perimeter structure defining the openings.

In some configurations, at least one of the plurality of second posts extends from each of the braces of the openings. In some configurations, at least one of the plurality of first posts extends from each of the corners of the perimeter structure defining the openings.

In some configurations, at least one of the plurality of second posts extends from a brace or corner of the perimeter structure defining each opening.

In some configurations, at least one of the plurality of first posts extends from a brace or corner of the perimeter structure defining each opening.

In some configurations, a thickness of the frame in a direction perpendicular to the first face of the frame is less than one eighth of an overall thickness of the urinal screen in the direction perpendicular to the first face of the frame.

In some configurations, when the urinal screen is set upon a surface such that the first or second face of the frame is oriented toward the surface, the frame is positioned away from the surface by at least one third of a thickness of the urinal screen as measured perpendicular to the first face of the frame.

According to some variants, a urinal screen includes a frame. The frame can have: a first face; a second face opposite the first face; and a plurality of openings extending through the frame between the first face and the second face. In some embodiments, the urinal screen includes a plurality of first posts extending from the first face of the frame. The urinal screen can include a plurality of second posts extending from the second face of the frame. In some embodiments, the plurality of openings occupy at least half of a surface area of the frame as observed perpendicular to the first face of the frame when the frame is set on a flat surface. In some case, the plurality of openings occupy at least 75% of the surface area of the frame as observed perpendicular to the first face of the frame when the frame is set on a flat surface.

In some configurations, each of the plurality of first posts is substantially identical to one or more of the plurality of second posts.

In some configurations, the perimeter structures of the plurality of openings occupy less than one fifth of a surface area of the frame as measured parallel to a first plane face of the frame, wherein the first plane face of the frame is a plane passing through the frame when the frame is set on a flat horizontal surface.

According to some variants, a urinal screen includes a frame. The frame can include: a first face; a second face opposite the first face; and a plurality of interconnected cells, each cell having a polygonal shape with a plurality of sides and corners. In some embodiments, the urinal screen includes a plurality of first posts extending from away from the first face, each of the plurality of first posts connected to a side or corner of the plurality of interconnected cells. In some embodiments, the urinal screen include a plurality of second posts extending away from the second face of the frame, each of the plurality of second posts connected to a side or corner of the plurality of interconnected cells. In some cases each of the interconnected cells shares at least one side and at least one corner with another interconnected cell.

In some configurations, the plurality of interconnected cells form a tessellation.

In some configurations, a thickness of the frame in a direction perpendicular to the first face of the frame is less than one fourth of an overall thickness of the urinal screen in the direction perpendicular to the first face of the frame.

BRIEF DESCRIPTION OF THE DRAWINGS

The present inventions are described with reference to the accompanying drawings, in which like reference characters reference like elements, and wherein.

DETAILED DESCRIPTION OF THE INVENTIONS

Figure 1:
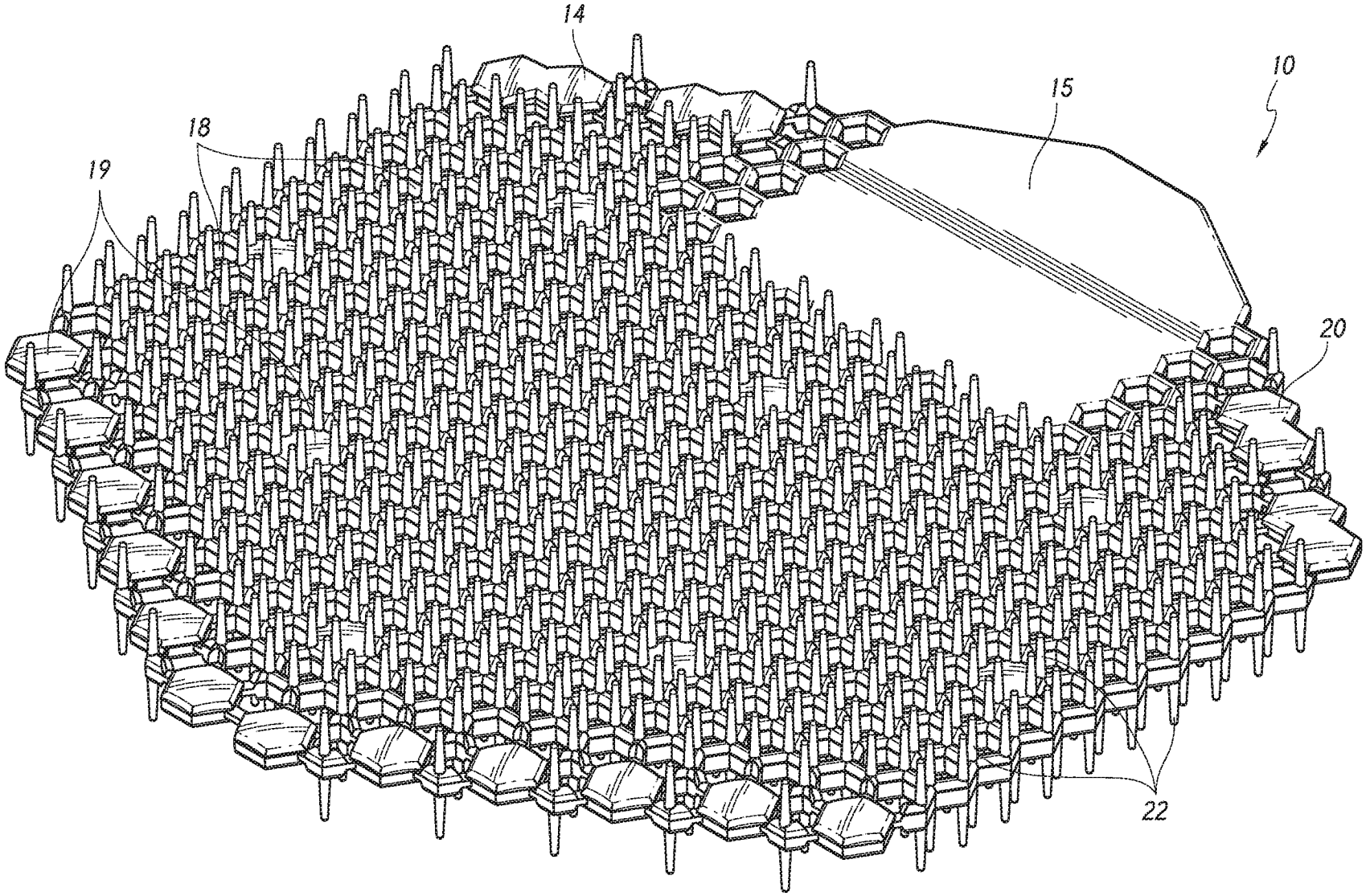
FIG. 1 is a perspective view of an embodiment of a urinal screen.
Figure 2:
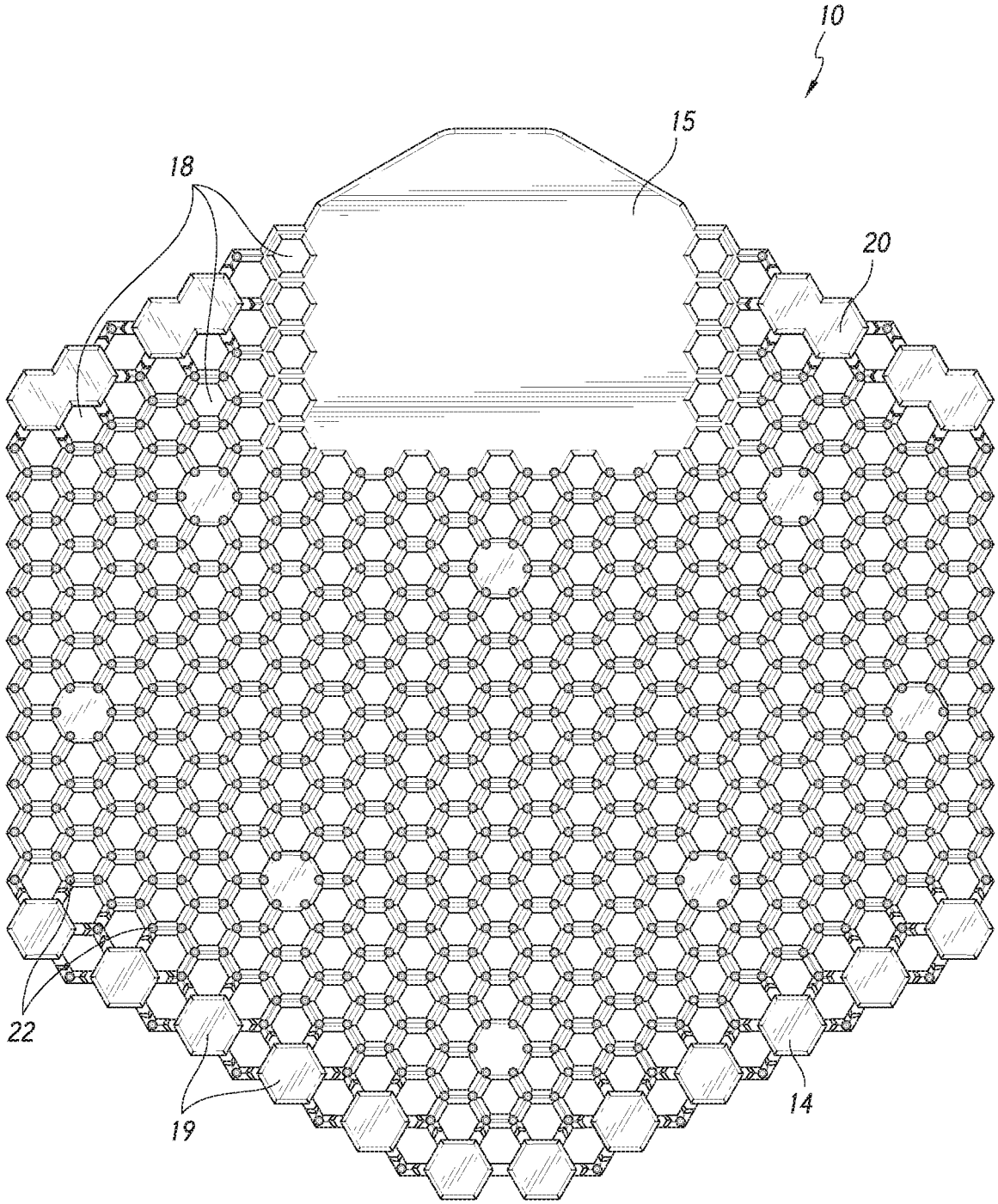
FIG. 2 is a top view of the urinal screen of FIG. 1.

An embodiment of a urinal screen 10 is illustrated in FIGS. 1-2. The urinal screen 10 can be sized and shaped to fit into a urinal, toilet, or other bathroom appliance. As illustrated, the urinal screen 10 can include a frame 14. The frame 14 can be sized and shaped to fit over all or a portion of a drain of a toilet or urinal. The frame 14 can define a plurality of openings 18 through a thickness of the frame 14. In some embodiments, the urinal screen 10 includes a plurality of posts or structural supports 22 extending from one or more surfaces of the frame 14.

In some embodiments, the screen 10 has a polygonal, elliptical, circular, or other overall shape. For example, as illustrated in FIG. 2, the screen 10 can have a generally hexagonal shape, though many other shapes are contemplated (e.g., rectangles, pentagons, triangles, circles, or some combination thereof). In some embodiments, the screen 10 is shaped to fit a particular urinal or toilet.

The frame 14 and/or posts 22 can be constructed from a polymeric or solid material. For example, the frame 14 and/or posts 22 can be constructed using a 3D printer. In some cases, additives are added to the material of the frame 14 and/or posts 22. Additives can include, for example, bacteria and/or odor neutralizers, silver ions, and other additives or combinations of additives. One method of manufacturing an embodiment of the urinal screen 10 can include providing plastic or EVA material, which may have a melting point of not greater than 250° F., loading the plastic or EVA with at least 15% to about 75% by weight of fragrance material to produce a fragranced plastic or EVA, loading the fragrance at a stage conducted at temperatures such that the fragranced plastic or EVA is from at least 15% by weight fragrance upon completion of the loading stage, and molding the fragranced plastic or EVA into a urinal screen, sized and shaped to be disposed in a urinal, forming openings 18 in the frame 14, and forming posts 22 extending from the frame 14.

The openings 18 can have various shapes, including, but not limited to, polygons (e.g., triangles, rectangles, pentagons, hexagons, etc.), ellipses, and/or some combination thereof. In some embodiments, each of the openings 18 has a substantially identical shape. In some embodiments, one or more of the openings 18 has a different shape from one or more of the other openings.

The openings 18 can occupy a large percentage of the overall surface area of the frame 14 as viewed in FIG. 2. For example, the openings 18 can occupy more than ⅛, more than ⅔, more than ⅓, more than ¼, more than ⅜, more than ½, more than ⅝, more than ⅔, and/or more than ¾ of the overall surface area of the frame 14 as viewed in FIG. 2. Utilizing a large number of openings 18 can reduce the overall weight of the urinal screen 10.

Figure 3:
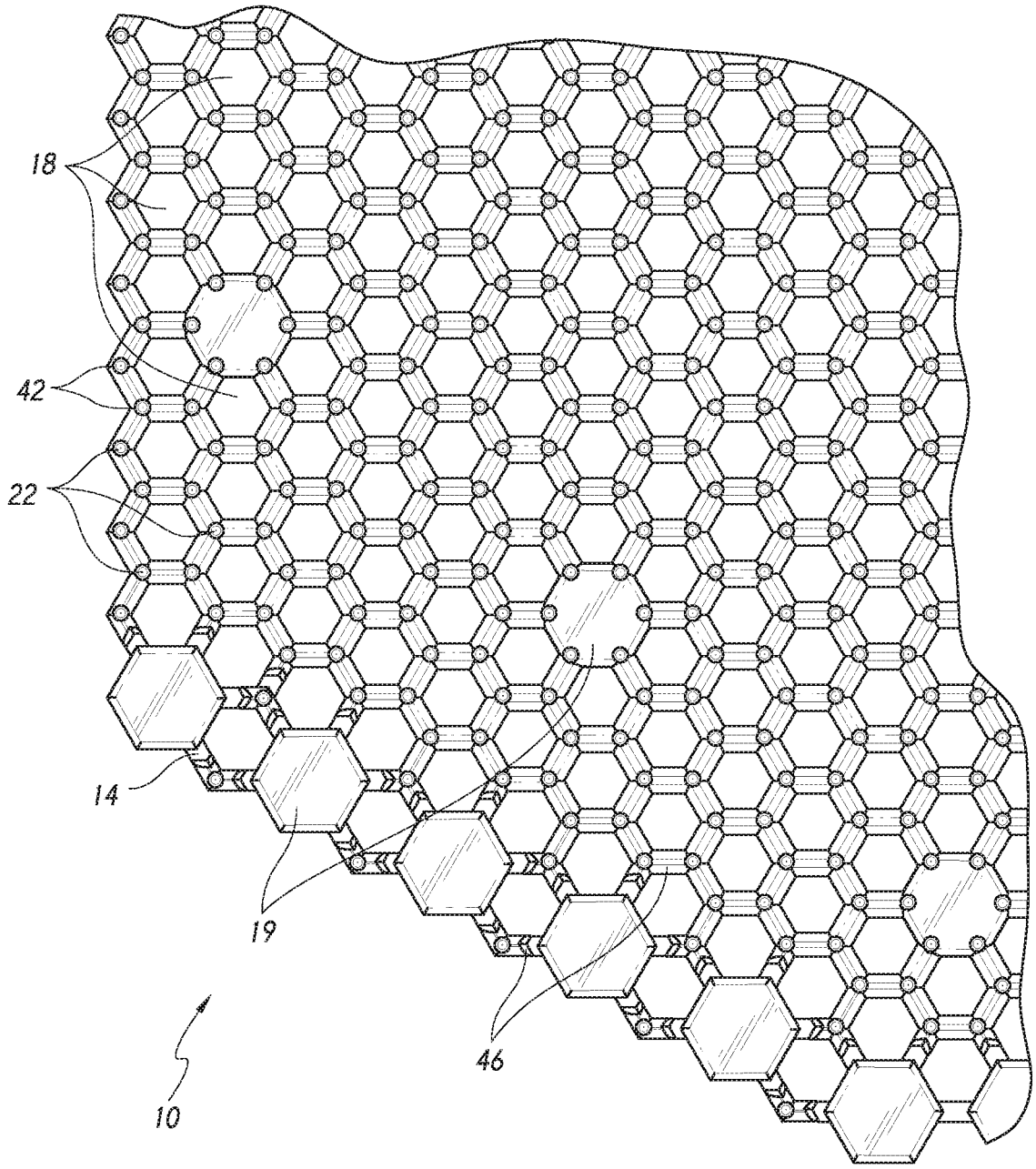
FIG. 3 is a front view of the urinal screen of FIG. 1.

A top surface (e.g., the first surface 26) of the frame 14 can lie on a first plane when the urinal screen 10 is set on a flat surface. In some cases, a bottom surface (e.g., the second surface 30) of the frame 14 can lie on a second plane when the urinal screen is set on a flat surface. In some embodiments, a maximum cross-sectional area of the frame 14 (e.g., the area not occupied by openings 18), as measured on a frame plane through the frame and parallel to the first and/or second planes is less than ½, less than ¼, less than ⅕, less than ⅙, less than ⅐, less than ⅛, less than ⅙, less than 1/10, less than 1/12, less than 1/15, and/or less than 1/20 of the area defined by the outer perimeter of the frame as measured in the plane. Many variations are possible As illustrated in FIGS. 2 and 3, one or more of the openings 18 (e.g., cells) can have a perimeter which includes a plurality of sides (e.g., braces) 42 and corners 46. In some cases, all or a portion of the frame 14 forms a tessellation of openings 18 wherein a plurality of the sides 42 of the openings 18 are shared between two or more openings 18. In some embodiments, each of the openings 18 shares at least one side and at least one corner with another opening.

In some cases, the sides 42 and/or corners 46 of the openings 18 have contoured (e.g., convex) upper and/or lower surfaces. The contoured surfaces of the sides 42 and corners 46 can deflect fluid (e.g., urine) to reduce splash in the urinal, toilet, or other environment in which the urinal screen 10 is installed.

In some embodiments, as illustrated in FIGS. 1 and 2, portions of the frame 14 include one or more solid or closed portions between or surrounding the openings 18. For example, the frame 14 can include one or more solid cells 19 positioned between and/or adjacent the openings 18 of the frame 14. The solid cells 19 can provide a surface area on which various letters, numbers, symbols, trademarks, and/or other visual features may be placed. For example, advertisements, installation instructions, date features, expiration dates, and/or other features may be included on the solid cells 19. In some embodiments, the frame 14 includes one or more intermediate solid cells 20 and/or large solid cells 15 for placement of larger/more complex visual features. For example, the intermediate solid cells 20 can occupy an area greater than or equal to 2, 3, 4, 5, and/or 6 openings 18. In some embodiments, the large solid cell 15 can occupy an area greater than or equal to 10 openings 18. Many variations are possible. In some embodiments, the one or more solid or closed portions facilitate easier removal of the screen 10 from a mold. In some cases, utilizing solid portions increases an amount of fragrance that can be embedded, coated, injected, or otherwise associated with the screen 10.

Figure 4:
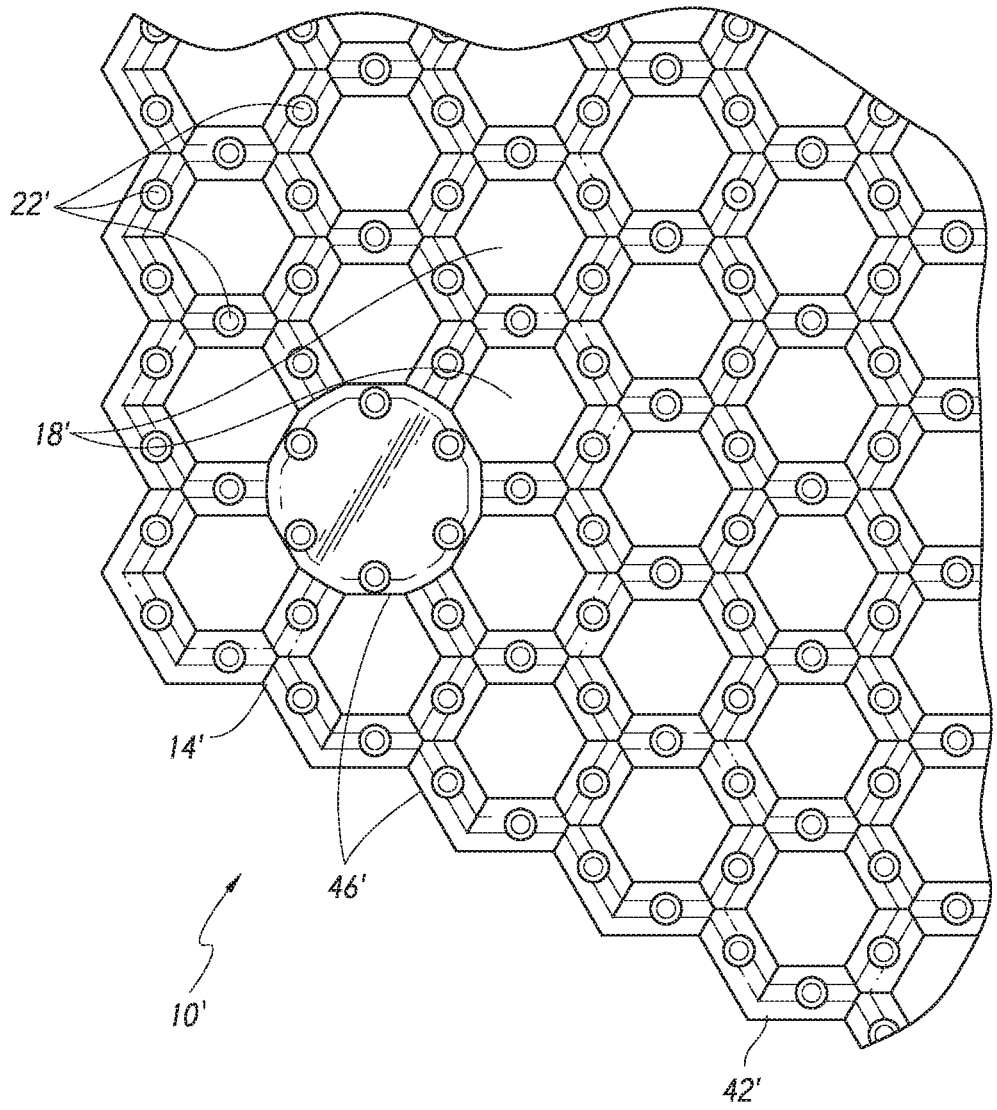
FIG. 4 is a close up top view of the urinal screen of FIG. 1.

In some embodiments, the posts 22 extend from the corners 46 of the frame forming openings 18. FIG. 4 illustrates an embodiment of a screen 10' wherein the posts 22' extend from the sides 42' (e.g., the midpoints of the sides 42') of the portions of the frame forming the openings 18' of the frame 14'. In some embodiments, posts 22 extend from both the portions of the fame forming the corners 46 and the portions of the frame forming the sides 42 or from some combination thereof. In some embodiments, posts 22 extend from the portions of the frame forming the corners 46 of the openings 18 on one side of the frame 14 (e.g., the first side 26, as shown in FIG. 5) and from the portions of the frame forming the sides 42 of the openings 18 on the other side of the frame 14 (e.g., the second side 30).

Figure 5:
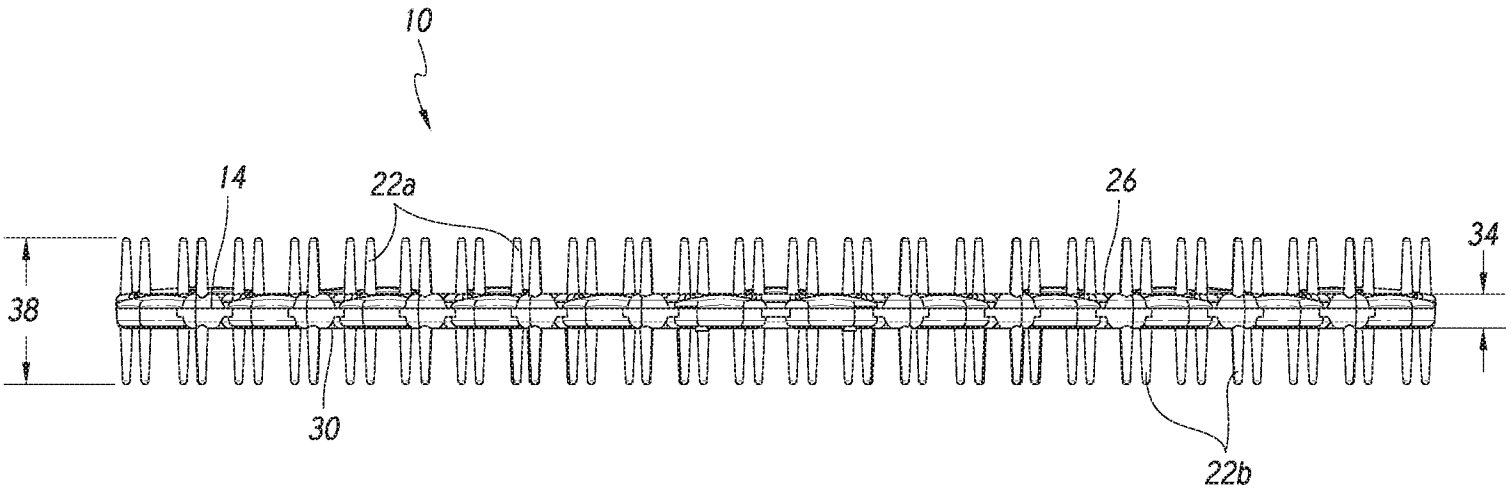
FIG. 5 is a close up top view of another embodiment of a urinal screen.

As illustrated in FIG. 5, the posts 22 can extend from a first surface 26 of the frame 14. In some embodiments, posts 22 extend from both the first surface 26 of the frame 14 and a second surface 30 of the frame 14. For example, a first plurality of posts 22*a* can extend from the first surface 26 of the frame 14 and a second plurality of posts 22*b* can extend from the second surface 30 of the frame 14. Each of the posts in the first plurality of posts 22*a* can be substantially identical to the each of the posts in the second plurality of posts 22*b*. For example, each of the posts can have the same height, width and/or overall shape.

Figure 6:
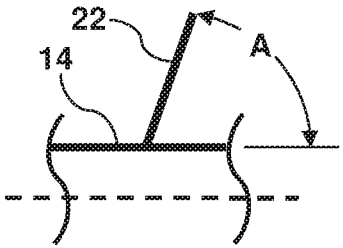
FIG. 6 is a schematic side view of a post extending from a frame of a urinal screen at a non-perpendicular angle.

In some embodiments, at least half, at least ¾, at least ⅕, at least ⅔, at least ⅓, at least 9/10, at least ⅘ and/or at least 1/10 of the first plurality of posts 22*a* have a same size and shape as at least half, at least ¾, at least ⅕, at least ⅔, at least ⅓, at least 9/10, at least ⅘ and/or at least 1/10 of the second plurality of posts 22*b*. In some embodiments, one or more of the posts in the first plurality of posts 22*a* has a different shape and/or height than one or more of the posts in the second plurality of posts 22*b*. In some embodiments, the first plurality of posts 22*a* and/or the second plurality of posts 22*b* have a plurality of heights. For example, a percentage (e.g., 25%, 50%, 75% or some other percentage) of the posts 22 can be shorter than the remaining posts as measured from the first or second surfaces 26, 30 of the frame 14. In some embodiments, at least ⅘, at least ⅗, at least ½, and/or at least ¼ of the posts 22 have a height differing from the remaining posts 22. In some embodiments, one or more of the posts 22 is at least ⅕, at least 1/10, at least ⅛, at least ¼, and/or at least ⅓ shorter than one or more of the other posts 22. In some cases, each post is at least ⅕ shorter, at least 1/10 shorter, at least ⅛ shorter, at least ¼ shorter, at least ⅓ shorter, at least ½ taller, at least ¼ taller, at least ⅛ taller, at least 1/10 taller, and/or at least 1/16 taller than at least one of the 3 closest posts 22, at least one of the 5 closest posts 22, at least one of the 7 closest posts 22, at least one of the 9 closest posts 22, at least one of the 10 closest posts 22, at least one of the 12 closest posts 22, and/or at least one of the 15 closest posts 22. In some embodiments, shortening a percentage of the posts 22 can reduce the likelihood that debris is caught in the urinal screen 10. The posts 22 can extend perpendicularly from the frame 14 (e.g., from the first or second surfaces 26, 30 of the frame 14). In some embodiments, one or more of the posts 22 extends from the frame 14 at a non-perpendicular angle (for example, non-perpendicular angle A of FIG. 6).

The frame 14 can have a generally planar or flat shape. In some embodiments, the frame 14 is curved or otherwise shaped in non-planar fashion. For example, the frame 14 can be molded in a non-planar shape to match the contours of a urinal or toilet.

The frame 14 can have a frame thickness 34 (e.g., a distance between the first and second surfaces 26, 30 of the frame 14). The frame thickness 34 can be uniform across the entire frame 14 or can vary in certain portions of the frame 14. An overall thickness 38 of the urinal screen 10 can be measured from a tip of the tallest post 22 extending from the first surface 26 of the frame 14 to a tip of the tallest post 22 extending from the second surface 30 of the fame 14 as measured perpendicularly from the first and second surfaces 26, 30. In some cases, wherein the frame 14 is not planar/flat, the overall thickness 38 of the urinal screen 10 can be determined via the tips of the posts 22 as measured perpendicularly to a tangent plane of the first surface 26 of the frame 14 at a point on the frame 14 where the thicknesses 34, 38 are being measured.

In some embodiments, the frame thickness 34 at a given position on the frame 14 is less than or equal to approximately ½ of the overall screen thickness 38 as measured perpendicularly to the first surface 26 of the frame 14 at the given position. In some embodiments, the frame thickness 34 is less than or equal to ⅔, less than or equal to ⅝, less than or equal to ⅜, less than or equal to ⅓, less than or equal to ¼, less than or equal to ⅖, less than or equal to ⅛, less than or equal to 1/10, less than or equal to 1/16, and/or less than or equal to 1/32 of the overall screen thickness 38. Use of a thin frame 14 can reduce the overall weight of the urinal screen 10.

In some embodiments, the urinal screen 10 is configured such that a plurality of posts 22 space the frame 14 from the installation surface of a urinal or other fixture onto which the urinal screen 10 is installed. The posts 22 space the frame 14 from the installation surface independent from the orientation of the urinal screen 10. For example, the second plurality of posts 22*b* can form a base of the urinal screen 10 and can space the frame 14 from the installation surface when the screen 10 is installed with the second surface 30 of the frame 14 facing the installation surface. On the other hand, the first plurality of posts 22*a* can form a base of the urinal screen 10 and can space the frame 14 from the installation surface when the screen 10 is installed with the first surface 26 of the frame facing the installation surface. In some embodiments, the posts 22 space the frame 14 from the installation surface by at least ⅓ of the overall thickness 38 of the urinal screen 10. In some embodiments, the posts 22 space the frame 14 from the installation surface by at least ⅛, at least ⅐, at least ⅙, at least ⅕, at least ¼, at least ⅜, and/or by at least 4/9 of the overall thickness 38 of the urinal screen 10.

Spacing the frame 14 from the installation surface can reduce the likelihood that the openings 18 are clogged by debris. In some embodiments, the posts 22 positioned between the frame 14 and the installation surface can reduce splashing in the urinal by deflecting urine or other fluids which pass between the frame 14 and the installation surface (e.g., fluid that passes through the openings 18 or around the perimeter of the frame 14).

For expository purposes, the term "horizontal" as used herein is defined as a plane parallel to the plane or surface of the floor of the area in which the system being described is used or the method being described is performed, regardless of its orientation. The term "floor" floor can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

The terms "approximately", "about", "generally" and "substantially" as used herein represent an amount close to the stated amount that still performs a desired function or achieves a desired result. For example, the terms "approximately", "about", "generally," and "substantially" may refer to an amount that is within less than 10% of the stated amount.

While the preferred embodiments of the present inventions have been described above, it should be understood that they have been presented by way of example only, and not of limitation. It will be apparent to persons skilled in the relevant art that various changes in form and detail can be made therein without departing from the spirit and scope of the inventions. Thus the present inventions should not be limited by the above-described exemplary embodiments, but should be defined only in accordance with the following claims and their equivalents. Furthermore, while certain advantages of the inventions have been described herein, it is to be understood that not necessarily all such advantages may be achieved in accordance with any particular embodiment of the inventions. Thus, for example, those skilled in the art will recognize that the inventions may be embodied or carried out in a manner that achieves or optimizes one advantage or group of advantages as taught herein without necessarily achieving other advantages as may be taught or suggested herein.

What is claimed is:

1. A reversible urinal screen comprising:

a plurality of interconnected cells that form a tessellation of openings, wherein a perimeter of each of a majority of openings of the tessellation of openings is at least partially defined by three or more braces of a plurality of braces, with a majority of the plurality of braces being shared by multiple openings; and a plurality of posts to deflect urine when the reversible urinal screen is placed upon a urinal surface, the plurality of posts connected to the plurality of braces and positioned such that:

when the reversible urinal screen is placed upon the urinal surface in a first orientation, a first plurality of tips of the plurality of posts support the plurality of braces above the urinal surface, and a second plurality of tips of the plurality of posts are positioned above the plurality of braces, and when the reversible urinal screen is placed upon the urinal surface in a second orientation, the second plurality of tips of the plurality of posts support the plurality of braces above the urinal surface, and the first plurality of tips of the plurality of posts are positioned above the plurality of braces, and wherein at least some of the plurality of braces comprise contoured upper and lower surfaces to deflect urine when the reversible urinal screen is placed upon the urinal surface in either of the first or second orientations.

2. The reversible urinal screen of claim 1, wherein the plurality of braces are centered in a vertical direction between the first plurality of tips and the second plurality of tips when the urinal screen is placed upon a horizontal surface.

3. The reversible urinal screen of claim 1, wherein the tessellation of openings are the only openings that pass through the reversible urinal screen.

4. The reversible urinal screen of claim 1, wherein the contoured upper and lower surfaces comprise convex surfaces.

5. The reversible urinal screen of claim 1, wherein at least some of the plurality of posts that are connected to the plurality of braces are connected at corners of the interconnected cells.

6. The reversible urinal screen of claim 1, wherein at least some of the plurality of posts that are connected to the plurality of braces are connected at midpoints of sides of the interconnected cells.

7. The reversible urinal screen of claim 1, wherein a majority of the plurality of posts that are connected to the plurality of braces are connected at corners of the interconnected cells.

8. The reversible urinal screen of claim 1, wherein a majority of openings of the tessellation of openings comprise a polygonal perimeter shape.

9. The reversible urinal screen of claim 1, wherein a majority of openings of the tessellation of openings comprise a four-sided perimeter shape.

10. The reversible urinal screen of claim 1, wherein a majority of openings of the tessellation of openings comprise a five-sided perimeter shape.

11. The reversible urinal screen of claim 1, wherein a majority of openings of the tessellation of openings comprise a six-sided perimeter shape.

12. The reversible urinal screen of claim 1, wherein some openings of the tessellation of openings comprise a different perimeter shape than other openings of the tessellation of openings.

13. The reversible urinal screen of claim 1, wherein some openings of the tessellation of openings comprise a perimeter shape having a different number of sides than other openings of the tessellation of openings.

14. The reversible urinal screen of claim 1, wherein some posts of the plurality of posts comprise a different height than other posts of the plurality of posts, as measured perpendicular to a horizontal surface when the urinal screen is placed upon the horizontal surface.

15. The reversible urinal screen of claim 1, wherein at least 25% of the plurality of posts comprise a shorter height than other posts of the plurality of posts, as measured perpendicular to a horizontal surface when the urinal screen is placed upon the horizontal surface.

16. The reversible urinal screen of claim 1, wherein the plurality of posts are oriented perpendicularly to a horizontal surface when the urinal screen is placed upon the horizontal surface.

17. The reversible urinal screen of claim 1, wherein at least some of the plurality of posts are oriented at a non-perpendicular angle to a horizontal surface when the urinal screen is placed upon the horizontal surface.

18. The reversible urinal screen of claim 1, wherein the plurality of braces and the plurality of posts comprise a fragranced EVA material.

19. The reversible urinal screen of claim 1, wherein the reversible urinal screen is molded.

20. A urinal system comprising:

the reversible urinal screen of claim 1; and a urinal comprising the urinal surface, the urinal surface having a drain extending therethrough, wherein the reversible urinal screen is placed upon the urinal surface.

21. A reversible urinal screen comprising:

a plurality of interconnected cells that form a tessellation of openings, wherein a perimeter of each of a majority of openings of the tessellation of openings is at least partially defined by three or more braces of a plurality of braces, with a majority of the plurality of braces being shared by multiple openings;

a solid portion positioned between at least some of the openings of the tessellation of openings, the solid portion occupying an area greater than or equal to ten of the openings of the tessellation of openings; and a plurality of posts to deflect urine when the reversible urinal screen is placed upon a urinal surface, the plurality of posts connected to the plurality of braces and positioned such that:

when the reversible urinal screen is placed upon the urinal surface in a first orientation, a first plurality of tips of the plurality of posts support the plurality of braces above the urinal surface, and a second plurality of tips of the plurality of posts are positioned above the plurality of braces, such that at least a portion of the plurality of posts between the second plurality of tips and the plurality of braces can reduce splashing of urine impacting the urinal screen from above, and at least a portion of the plurality of posts between the first plurality of tips and the plurality of braces can reduce splashing of urine that has passed through the tessellation of openings, and when the reversible urinal screen is placed upon the urinal surface in a second orientation, the second plurality of tips of the plurality of posts support the plurality of braces above the urinal surface, and the first plurality of tips of the plurality of posts are positioned above the plurality of braces, such that at least a portion of the plurality of posts between the first plurality of tips and the plurality of braces can reduce splashing of urine impacting the urinal screen from above, and at least a portion of the plurality of posts between the second plurality of tips and the plurality of braces can reduce splashing of urine that has passed through the tessellation of openings, wherein at least some of the plurality of braces comprise contoured upper and lower surfaces to deflect urine when the reversible urinal screen is placed upon the urinal surface in either of the first or second orientations, wherein, when the urinal screen is placed upon a horizontal surface, a thickness of the majority of the plurality of braces as measured perpendicular to the horizontal surface is less than or equal to ½ of an overall thickness of the urinal screen as measured perpendicular to the horizontal surface, wherein a majority of the plurality of posts that are connected to the plurality of braces are connected at corners of the interconnected cells, wherein some openings of the tessellation of openings comprise a different perimeter shape than other openings of the tessellation of openings, and wherein the plurality of braces, the plurality of posts, and the solid portion comprise a fragranced EVA material.

22. The reversible urinal screen of claim 21, wherein the reversible urinal screen comprises a generally circular shape.

23. The reversible urinal screen of claim 21, wherein the reversible urinal screen comprises a generally hexagonal shape.

24. The reversible urinal screen of claim 21, wherein the tessellation of openings comprise at least half of a surface area of the urinal screen as observed perpendicular to a flat surface when the urinal screen is placed on the flat surface.

25. The reversible urinal screen of claim 21, wherein at least some of the plurality of posts comprise a different size than at least some other of the plurality of posts.

26. The reversible urinal screen of claim 21, wherein the plurality of braces are centered in a vertical direction between the first plurality of tips and the second plurality of tips when the urinal screen is placed upon a horizontal surface.

27. The reversible urinal screen of claim 21, wherein the contoured upper and lower surfaces comprise convex surfaces.

28. A reversible urinal screen comprising:

a plurality of interconnected cells that form a tessellation of openings, wherein a perimeter of each of a majority of openings of the tessellation of openings is at least partially defined by three or more braces of a plurality of braces, with a majority of the plurality of braces being shared by multiple openings;

a solid portion positioned between at least some of the openings of the tessellation of openings, the solid portion occupying an area greater than or equal to ten of the openings of the tessellation of openings; and a plurality of posts to deflect urine when the reversible urinal screen is placed upon a urinal surface, the plurality of posts connected to the plurality of braces and positioned such that:

when the reversible urinal screen is placed upon the urinal surface in a first orientation, a first plurality of tips of the plurality of posts support the plurality of braces above the urinal surface, and a second plurality of tips of the plurality of posts are positioned above the plurality of braces, such that at least a portion of the plurality of posts between the second plurality of tips and the plurality of braces can reduce splashing of urine impacting the urinal screen from above, and at least a portion of the plurality of posts between the first plurality of tips and the plurality of braces can reduce splashing of urine that has passed through the tessellation of openings, and when the reversible urinal screen is placed upon the urinal surface in a second orientation, the second plurality of tips of the plurality of posts support the plurality of braces above the urinal surface, and the first plurality of tips of the plurality of posts are positioned above the plurality of braces, such that at least a portion of the plurality of posts between the first plurality of tips and the plurality of braces can reduce splashing of urine impacting the urinal screen from above, and at least a portion of the plurality of posts between the second plurality of tips and the plurality of braces can reduce splashing of urine that has passed through the tessellation of openings, wherein, when the urinal screen is placed upon a horizontal surface, a thickness of the majority of the plurality of braces as measured perpendicular to the horizontal surface is less than or equal to ½ of an overall thickness of the urinal screen as measured perpendicular to the horizontal surface, wherein the perimeter of each of the majority of openings of the tessellation of openings comprises a plurality of corners, with a post being connected at each of the corners, and wherein the plurality of braces, the plurality of posts, and the solid portion comprise a fragranced EVA material.

29. The reversible urinal screen of claim 28, wherein the reversible urinal screen comprises a generally circular shape.

30. The reversible urinal screen of claim 28, wherein the reversible urinal screen comprises a generally hexagonal shape.

31. The reversible urinal screen of claim 28, wherein the tessellation of openings comprise at least half of a surface area of the urinal screen as observed perpendicular to a flat surface when the urinal screen is placed on the flat surface.

32. The reversible urinal screen of claim 28, wherein at least some of the plurality of posts comprise a different size than at least some other of the plurality of posts.

33. The reversible urinal screen of claim 28, wherein the plurality of braces are centered in a vertical direction between the first plurality of tips and the second plurality of tips when the urinal screen is placed upon a horizontal surface.

* * * * *